US009739043B2

(12) United States Patent
Seki et al.

(10) Patent No.: US 9,739,043 B2
(45) Date of Patent: Aug. 22, 2017

(54) URINAL

(71) Applicant: TOTO LTD., Kitakyushu-shi, Fukuoka (JP)

(72) Inventors: Yoshifumi Seki, Kitakyushu (JP); Satoshi Matsunaka, Kitakyushu (JP); Yuichi Furuta, Kitakyushu (JP); Hironori Yamasaki, Kitakyushu (JP)

(73) Assignee: TOTO LTD., Kitakyushu-Shi, Fukuoka (JP)

( * ) Notice: Subject to any disclaimer, the term of this patent is extended or adjusted under 35 U.S.C. 154(b) by 0 days.

(21) Appl. No.: 14/994,748

(22) Filed: Jan. 13, 2016

(65) Prior Publication Data

US 2016/0208474 A1 Jul. 21, 2016

(30) Foreign Application Priority Data

Jan. 20, 2015 (JP) ..... 2015-008763

(51) Int. Cl.
*E03D 13/00* (2006.01)
*E03D 11/18* (2006.01)

(52) U.S. Cl.
CPC ..... *E03D 13/00* (2013.01); *E03D 11/18* (2013.01)

(58) Field of Classification Search
CPC ..... E03D 13/00
See application file for complete search history.

(56) References Cited

U.S. PATENT DOCUMENTS 5,305,473 A * 4/1994 Nakamura ..... E03D 13/00 4/306

FOREIGN PATENT DOCUMENTS

EP 1837447 9/2007

OTHER PUBLICATIONS

Search Report and Written Opinion for Singapore Application No. 10201600261 U, Completed by the Singapore Patent Office on Feb. 22, 2016, 8 Pages.

* cited by examiner

*Primary Examiner* — Janie Loeppke
(74) *Attorney, Agent, or Firm* — Brooks Kushman P.C.

(57) ABSTRACT

A urinal for receiving and discharging urine having a bowl portion having a bowl surface for receiving urine; a spouting device disposed on a top portion of the bowl portion for spouting flush water onto the bowl surface; and a discharge trap portion, communicating with a discharge port disposed on a bottom portion of the bowl portion, for discharging flush water and forming a water seal on a downstream side of the bowl portion. The discharge trap includes a descending conduit, a horizontal conduit, and an ascending conduit, and a cross section perpendicular to a discharging direction of either the horizontal conduit or the ascending conduit on the discharge trap portion is formed so that an inner side of the urinal from a center of the cross section has a smaller cross sectional area than an outer side of the urinal from the center of the cross section.

13 Claims, 6 Drawing Sheets

URINAL

CROSS-REFERENCE TO RELATED APPLICATIONS

This application claims priority to JP application JP 2015-008763 filed on Jan. 20, 2015, the disclosure of which is incorporated in its entirety by reference herein.

TECHNICAL FIELD

The present invention relates to a urinal, and in particular to a urinal for receiving and discharging urine.

BACKGROUND

As shown in Japanese Patent Unexamined Publication 2013-14965 (Patent Document 1) and Japanese Patent Unexamined Publication 2011-214262 (Patent Document 2), urinals comprising a discharge trap at the bottom of a bowl portion for receiving a user's urine are known.

In the urinal shown in Patent Document 1 and Patent Document 2, a discharge trap has: a downward extending descending conduit, a horizontal conduit bending gradually from the descending conduit and extending horizontally, and an ascending conduit similarly gradually bending from the horizontal conduit and extending upward; and is approximately U-shaped.

A predetermined amount of pooled water is constantly pooled at the bottom portion of the discharge trap in order to prevent the intrusion of foul odors or the like from drain pipes; a water seal is formed by the pooled water.

In the type of conventional urinal, when a user urinates urine flows into the discharge trap; the majority of pooled water is discharged by the inflow of urine, and inside the discharge trap a liquid with a high urine concentration mixture of urine and water is present as pooled water.

When flush water is supplied to the bowl portion to flush the bowl portion after use by a user, the flush water once again flows from the bowl portion into the discharge trap; high urine concentration pooled water is discharged from the discharge trap, and high urine concentration pooled water in which urine and water are mixed in the discharge trap is replaced by low urine concentration flush water newly flowing into the discharge trap.

In the past, the problem has occurred that if the substitution rate (the ratio at which pooled water pooled in the discharge trap is substituted by new flush water) is low when the high urine concentration pooled water consisting of mixed urine and water in a discharge trap is substituted by flush water with a low urine concentration newly flowing into the discharge trap, the urine concentration in the post-substitution pooled water increases, making it easier for uric scale to form.

SUMMARY

Problems to be Solved by the Invention

On the other hand, in recent years, the call for water conservation stemming from higher environmental awareness has increased even further, leading to a demand that the amount of flush water used to flush the bowl portion be reduced.

However when the flush water amount is reduced, the amount of flush water for substituting high urine concentration pooled water is also reduced, so that the pooled water substitution rate is decreased, leaving the post-substitution pooled water urine concentration high, so that uric scale can easily form in the discharge trap.

Therefore an improvement is sought in the substitution rate so that high urine concentration pooled water is substituted even when the flush water amount is relatively slow.

In connection with the problem, the present inventors have discovered the following knowledge through diligent research.

First, forming the discharge trap compactly and forming the water seal with a small amount of pooled water is one conceivable way to improve the substitution rate, but when the discharge trap is compactly formed, the bends from the descending conduit of the discharge trap to the horizontal conduit and from the horizontal conduit to the ascending conduit are sharpened, and the direction of flow within the discharge trap changes suddenly in each conduit connecting portion.

A flush water flow speed differential between the inner side and the outer side of the urinal can therefore easily occur in each of the conduit connecting portions.

It was thus discovered that if a flush water flow speed differential between the inner side of the urinal and the outer side of the urinal occurs in each of the conduit connecting portions, flush water flow stagnation can easily occur so that the pooled water substitution rate inside the discharge trap cannot be improved.

It is therefore an object of the present invention to provide a urinal with which a pooled water substitution rate can be improved and a depositing of uric scale in a discharge trap can be constrained.

Means to Solve the Problems

The above object is achieved according to the present invention by providing a urinal for receiving and discharging urine, comprising a bowl portion having a bowl surface for receiving urine, a spouting device disposed on a top portion of the bowl portion for spouting flush water onto the bowl surface, and a discharge trap portion, communicating with a discharge port disposed on a bottom portion of the bowl portion, for discharging flush water and forming a water seal on s downstream side of the bowl portion; wherein the discharge trap includes a descending conduit extending downward from a discharge port, a horizontal conduit connected to the descending conduit and extending horizontally, and an ascending conduit connected to the outlet of the horizontal conduit and extending upward; and wherein a cross section perpendicular to the discharging direction of either the horizontal conduit or the ascending conduit on the discharge trap portion is formed so that an inner side of the urinal from a center of the cross section has a smaller cross sectional area than an outer side of the urinal from the center of the cross section.

In the present invention thus constituted, because the cross section perpendicular to the draining direction of either the horizontal conduit or the ascending conduit on the discharge trap portion is formed so that the inner side of the urinal from the center of the cross section has a smaller cross sectional area than the outer side of the urinal from the center of the cross section, speed differences between the flow speed on the side to the inside of the center of the cross section of the discharge trap portion horizontal conduit or ascending conduit and the flow speed on the side to the outside of the center of the cross section are constrained, and by the means stagnation of flow in the horizontal conduit or ascending conduit is constrained, therefore the substitution rate of pooled water inside the discharge trap portion can be improved, and deposition of uric scale in the horizontal conduit or ascending conduit can be constrained.

In a preferred embodiment, the ascending conduit of the discharge trap portion is formed so that a cross sectional area thereof is essentially constant from an inlet thereof to an outlet thereof.

In the present invention thus constituted, the discharge trap portion ascending conduit is formed so that the cross sectional area thereof is essentially constant from the inlet to the outlet thereof, thereby inhibiting changes in flow speed within the ascending conduit on the discharge trap portion, so that stagnation of flows in the ascending conduit of the discharge trap portion is constrained, thereby further constraining the deposition of uric scale in the ascending conduit.

Note that "essentially constant" here includes cases where the cross sectional area is completely constant, and also includes "essentially constant" cases of a degree sufficient to present the same effect as in the completely constant case.

In another preferred embodiment, the descending conduit of the discharge trap portion is formed so that a cross sectional area gradually decreases from an inlet thereof to an outlet thereof.

In the present invention thus constituted, the discharge trap portion descending conduit is formed so that the cross sectional area gradually decreases from the inlet to the outlet, therefore substitution of pooled water inside the discharge trap portion is performed quickly due to the increased flow speed inside the descending conduit heading toward the downstream side, hence deposition of uric scale in the horizontal conduit and ascending conduit can be constrained.

In still another preferred embodiment, descending conduit of the discharge trap portion is formed so that a cross section thereof is essentially circular.

In the present invention thus constituted, the descending conduit of the discharge trap portion is formed so that the cross section is essentially circular, therefore the cross section surface area of the descending conduit is larger than the surface area of the inlet to the horizontal conduit, and flows into the horizontal conduit are accelerated from the interior of the descending conduit, so that stagnation of flow in the horizontal conduit is constrained, thereby enabling the deposition of uric scale in the horizontal conduit to be constrained.

Note that "essentially circular" here includes cases where the cross sectional area is completely constant, and also includes "essentially circular" cases, such as ellipses, of a degree sufficient to present the same effect as completely circular cases.

In another preferred embodiment of the present invention, the horizontal conduit and ascending conduit of the discharge trap portion are respectively formed so that the cross sectional width dimensions thereof are essentially the same size as the minimum width dimension of the flow path cross section of the descending conduit outlet.

In the present invention thus constituted, the horizontal conduit and ascending conduit of the discharge trap portion are respectively formed so that the cross sectional width dimensions thereof are essentially the same size as the minimum width dimension of the flow path cross section of the descending conduit outlet, therefore the flow speed of discharged water in the discharge trap portion is maintained, and the occurrence of turbulence is inhibited, so that stagnation of flows in the horizontal conduit or ascending conduit is constrained; hence substitution of pooled water inside the discharge trap portion is performed quickly, such that deposition of uric scale in the horizontal conduit and ascending conduit can be constrained.

Note that "essentially the same" here includes cases of being completely the same, and also includes "essentially the same" cases of a degree sufficient to present the same effect as completely same cases.

Effect of the Invention

In the urinal of the present invention, the pooled water substitution rate can be improved, and deposition of uric scale in the discharge trap can be constrained.

DETAILED DESCRIPTION

Next, referring to the attached drawings, the basic structure of a urinal according to an embodiment of the present invention will be explained.

Figure 1:
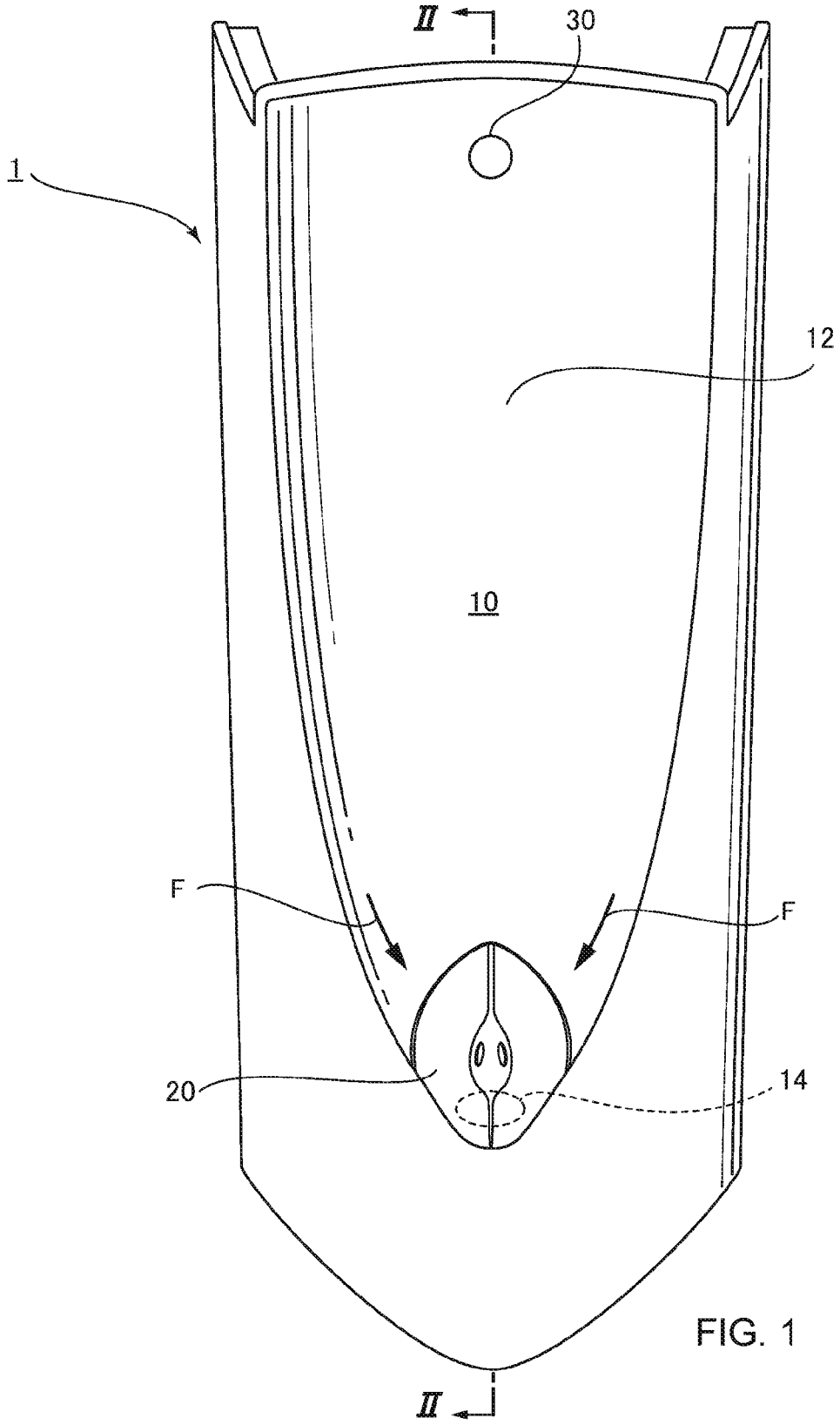
FIG. 1 is a front elevation perspective view seen from in front and above a urinal according to an embodiment of the present invention.
Figure 2:
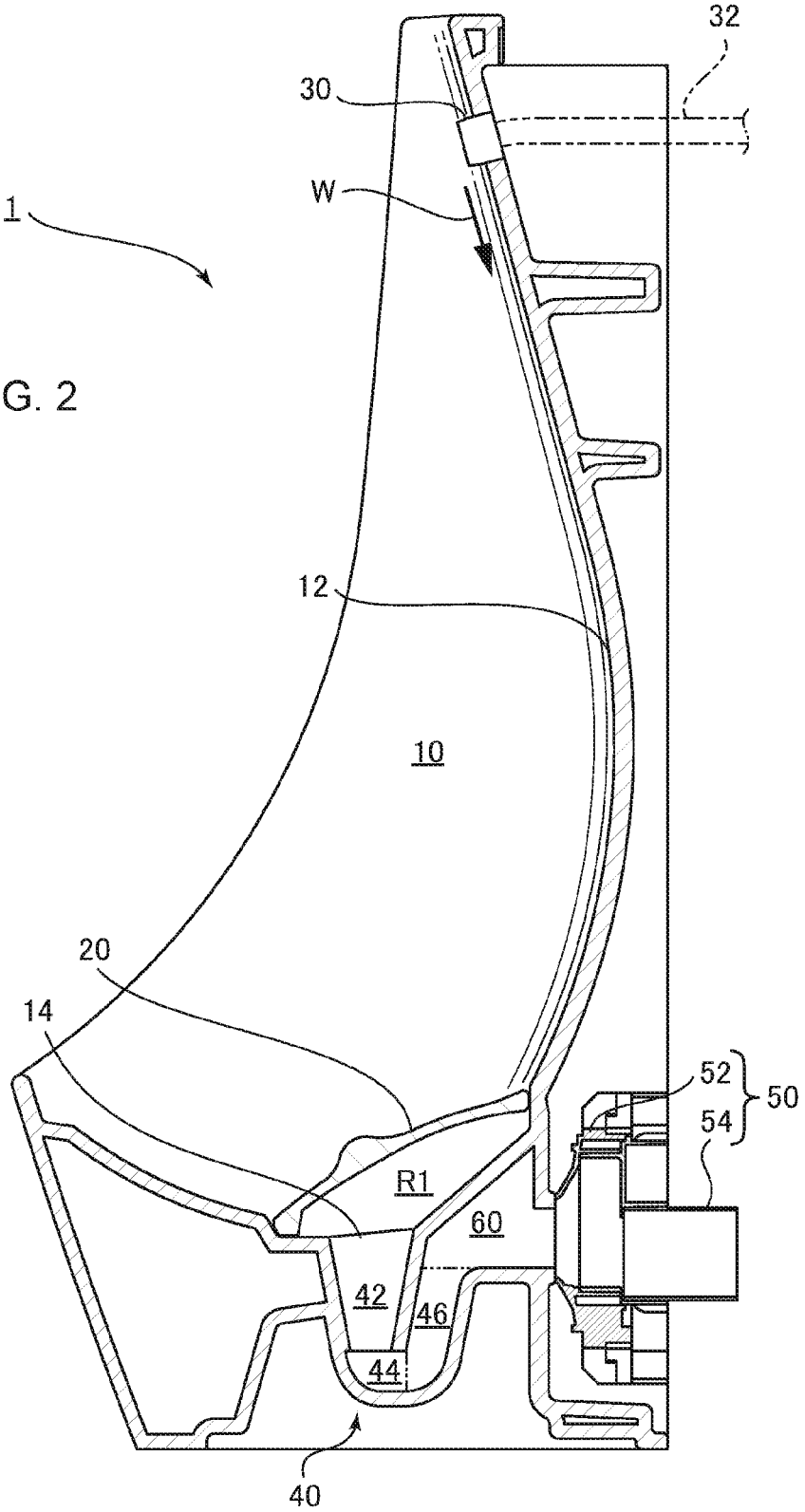
FIG. 2 is a cross section seen along line II-II in FIG. 1.

FIG. 1 is a front elevation perspective view seen from in front and above a urinal according to an embodiment of the present invention, and FIG. 2 is a cross section seen along line II-II in FIG. 1.

As shown in FIGS. 1 and 2, a urinal 1 according to an embodiment of the present invention comprises a bowl portion 10 formed in a bowl shape on the front side.

A bowl surface 12 for receiving a user's urine is formed on the bowl portion 10; when seen in the vertical direction, the top portion of the bowl surface 12 is formed as an arced surface with a relatively large curvature radius, and the bottom portion thereof is formed as an arced surface with a relatively small curvature radius, while the bottom portion thereof is formed to converge as it curves in a bowl shape.

A spout apparatus 30 for spouting flush water W for flushing bowl surface 12 is disposed at the top of the bowl portion 10; a water supply pipe 32 supplying flush water W is connected at the rear side of the spout device 30.

The spout device 30 spouts flush water W to the bowl surface 12 based on a detection signal from a body sensor (not shown) and a predetermined control program, etc.

A discharge port 14, to which flush water used to flush the bowl surface 12 is discharged, is formed at the lowermost position of a bottom region R1 inside the bowl portion 10, and a discharge trap portion 40 communicating with the discharge port 14 is formed on the downstream side of the discharge port 14.

A mesh 20 covering the discharge port 14 is mounted on the bowl portion 10.

Figure 3:
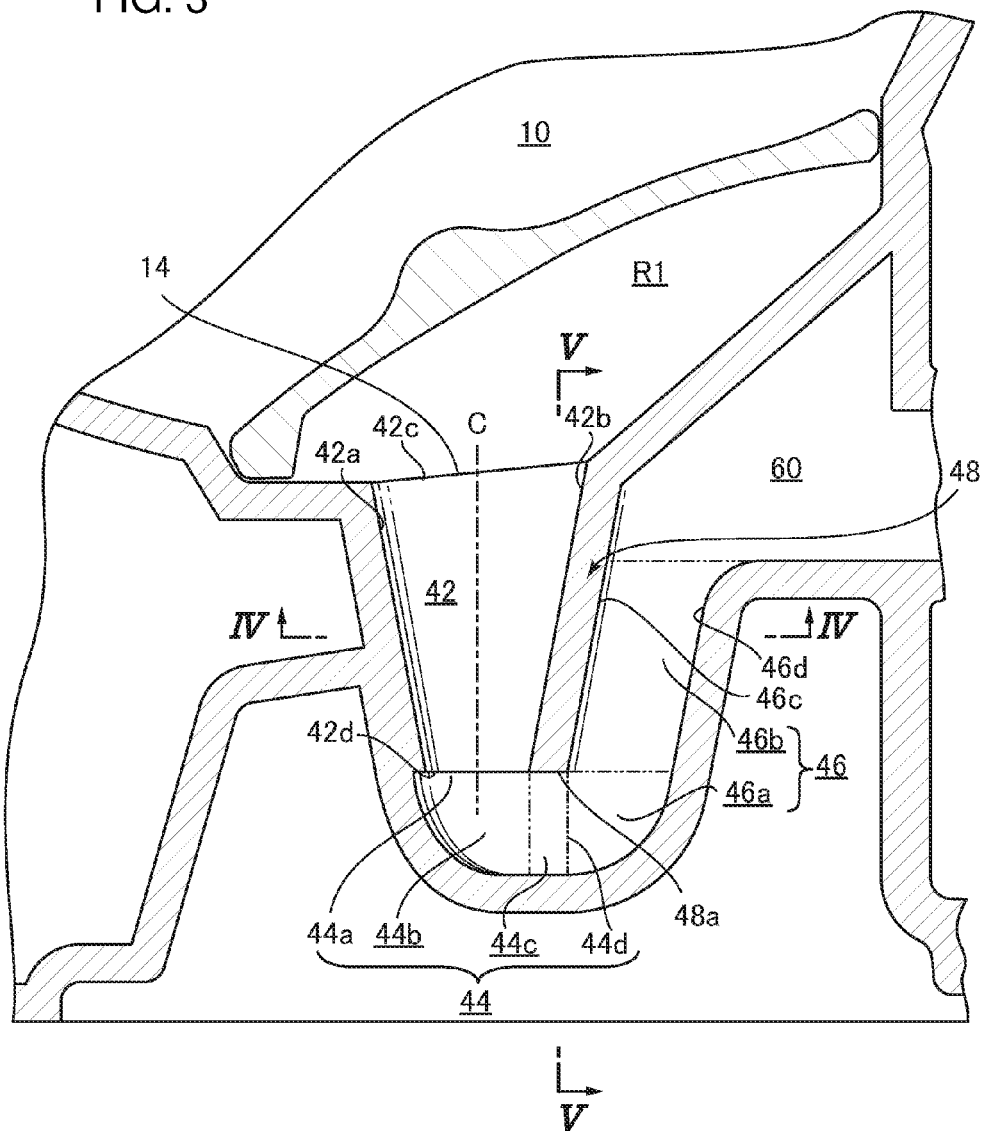
FIG. 3 is a partial enlarged cross section in the vicinity of the discharge trap portion of the urinal shown in FIG. 2.

The discharge trap portion 40 comprises: a descending conduit 42 extending downward from the discharge port 14, a horizontal conduit 44 connected to the outlet 42*d* of the descending conduit 42 (see FIG. 3) and extending horizontally from the descending conduit 42 with a gradual bend to the horizontal conduit 44; and an ascending conduit 46 connected to the horizontal conduit outlet 44*d* of the horizontal conduit 44 (see FIG. 3) and extending similarly in a gradual bend upward from the outlet 44*d* of the horizontal conduit 44 (see FIG. 3).

Flush water accumulates as pooled water in the horizontal conduit 44; a water seal is thus formed inside the discharge trap portion 40, and foul odors, etc. from sewers, etc. outside the urinal 1 are prevented from spilling out into the bowl portion 10 and the toilet space in the vicinity thereof.

The descending conduit 42 and the ascending conduit 46 are adjacent, mediated by a common wall 48; by the means the size of the discharge trap portion 40 is compacted, and the amount of pooled water stored inside the discharge trap portion 40 is reduced compared to conventional urinals.

A discharge chamber 60 is connected to the downstream side of the discharge trap portion 40, and flush water (discharge water) which has flushed the bowl surface 12 and flowed into the discharge trap portion 40 from the discharge port 14 is made to discharge to the discharge pipe portion 50 on the rear surface outer side of the urinal 1 by the discharge chamber 60.

The drain pipe portion 50 comprises a drain socket 52 connected at one end to the discharge chamber 60, and drain pipe 54, connected to the other end of the drain socket 52.

Note that, in the present embodiment, the drain socket 52 is connected to the discharge chamber 60, but the drain pipe 54 may also be directly connected to the discharge chamber 60 without disposing a drain socket 52.

In the present embodiment, the discharge chamber 60 is integrally formed with the ascending conduit 46 on the discharge trap portion 40, but may also be formed as a separate body from the discharge trap portion 40 using resin or the like.

Next, using FIGS. 3 through 5, details of the discharge trap portion according to an embodiment of the present invention will be explained.

FIG. 3 is a partial enlarged cross section close to the discharge trap portion of the urinal shown in FIG. 2; FIG. 4 is a partial cross section seen along line IV-IV in FIG. 3; and FIG. 5 is a partial cross section seen along line V-V of FIG. 3.

Figure 4:
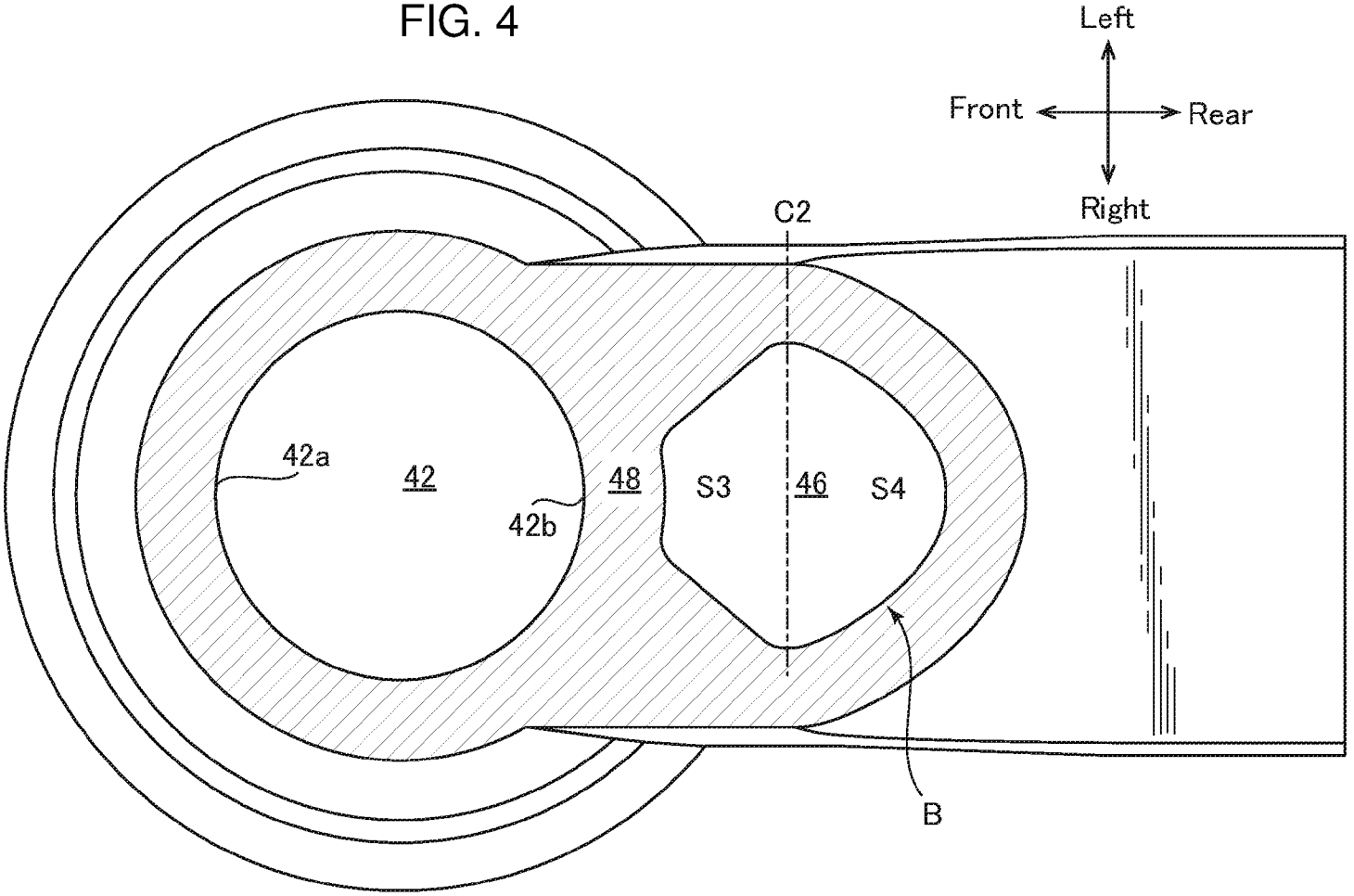
FIG. 4 is a partial cross section seen along line IV-IV in FIG. 2.

As shown in FIG. 4, the descending conduit 42 on the discharge trap portion 40 has an essentially circular shape in section.

As is further shown in FIG. 3, the descending conduit 42 is formed by a descending conduit front wall 42*a* on the front side of the descending conduit 42, and a common wall 48 forming a descending conduit rear wall 42*b* on the rear side of the descending conduit 42.

The descending conduit front wall 42*a* and descending conduit rear wall 42*b* of the descending conduit 42 are essentially symmetrical about the center axis line C of the descending conduit 42, and are formed to have a diminishing cross sectional area in the downstream direction.

For the reason, the descending conduit 42 entrance 42*c* cross sectional area is formed to be the largest, and the outlet 42*d* is formed to be the smallest.

The horizontal conduit 44 of the discharge trap portion 40 comprises a horizontal conduit inlet 44*a* connected to the outlet 42*d* on the descending conduit 42, a first bent portion 44*b* for changing the flow path in the vertical direction to a horizontal flow path, a horizontal portion 44*c* connected to the downstream side of the first bent portion 44*b* and forming a flow path in the horizontal direction, and a horizontal conduit outlet 44*d* on the downstream end of the horizontal portion 44*c* connected to the ascending conduit 46, described below; whereby falling flush water is smoothly introduced into the horizontal portion 44*c* of the horizontal conduit 44.

Figure 5:
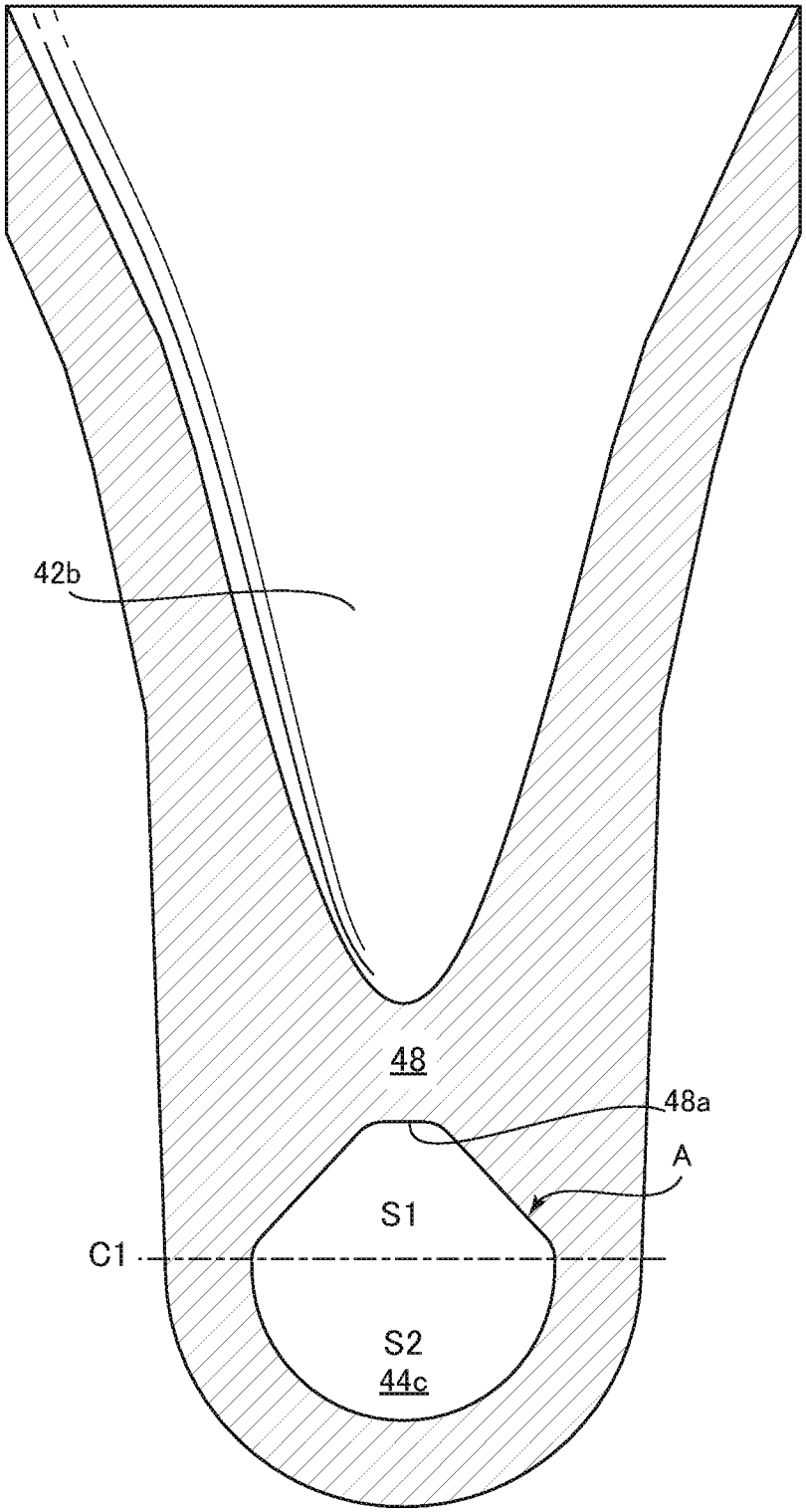
FIG. 5 is a partial cross section seen along line V-V in FIG. 2.
Figure 6:
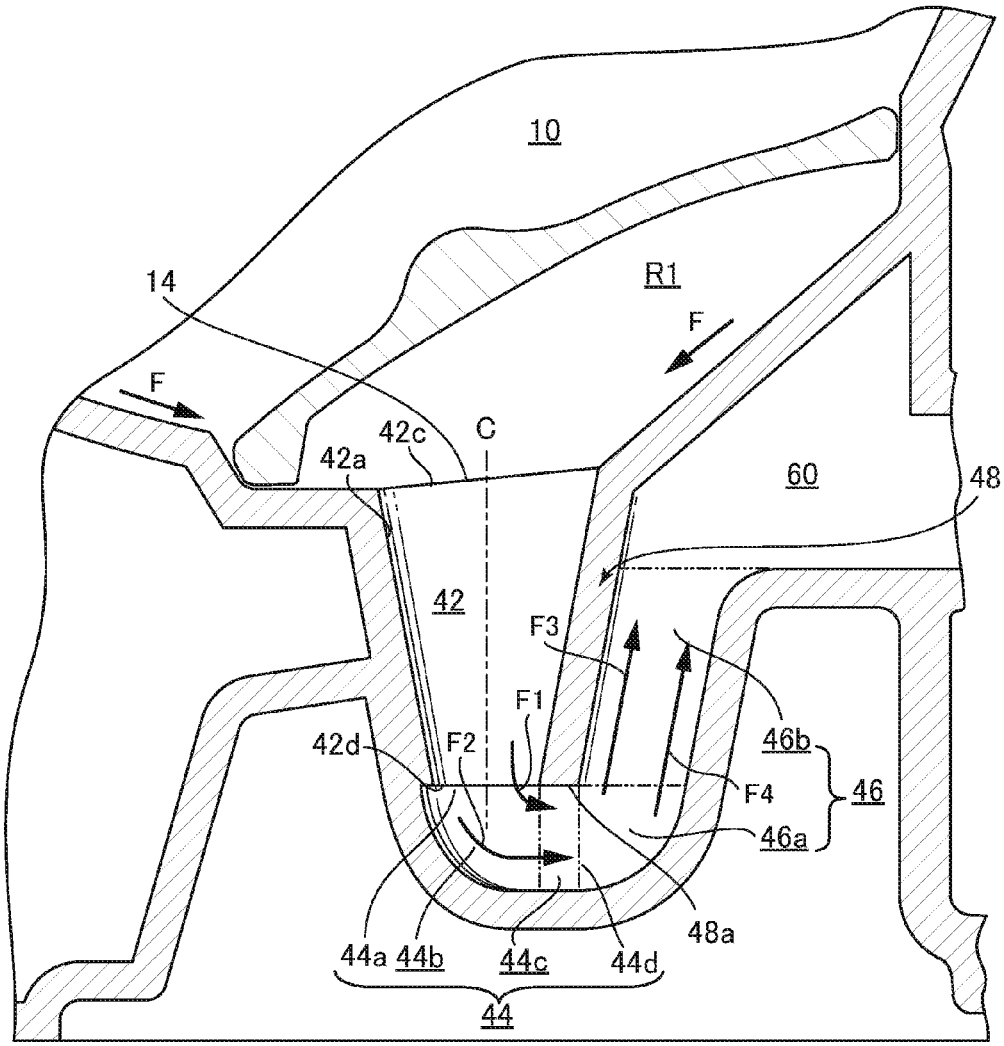
FIG. 6 is a diagram showing the flow of flush water in the urinal according to an embodiment of the present invention.

As shown in FIG. 5, the shape of cross section A on the horizontal portion 44*c* of the horizontal conduit 44 is essentially semicircular relative to the vertical direction center line C1 of cross section A on the urinal outer side (bottom side), and essentially trapezoidal on the urinal inner side (top side).

Therefore in the cross section A of the horizontal portion 44*c* of the horizontal conduit 44, the surface area S1 on the inner side of the urinal is smaller than the surface area S2 on the outside of the urinal.

Note that the dimension of the height in the vertical direction of the cross section of the horizontal conduit 44 on the discharge trap portion 40 is essentially the same as the smallest width dimension of the flow path cross section of the outlet 42*d* on the descending conduit 42.

The cross sectional shape of the first bent portion 44*b* of the horizontal conduit 44 has the same shape as the horizontal portion 44*c* of the horizontal conduit 44 across the whole range in the flow direction, but it is also acceptable for the shape to change continuously toward the downstream side from the cross sectional shape of the descending conduit 42 to the cross sectional shape of the horizontal portion 44*c* of the horizontal conduit 44.

The discharge trap portion 40 ascending conduit 46 comprises a second bending portion 46*a*, the inlet of which connects to the horizontal conduit 44 outlet 44*d* and changes the horizontal flow path to a vertical flow path, and an ascending portion 46*b* connected to the outlet of the second bending portion 46*a* and extending upward; whereby flush water is smoothly supplied to the ascending conduit 46 ascending portion 46*b* by the second bending portion 46*a*.

The ascending portion 46*b* of the ascending conduit 46 comprises an ascending portion front wall 46*c* on the front side, formed by the common wall 48, and an ascending portion rear wall 46*d* on the rear side; the ascending portion front wall 46*c* and ascending portion rear wall 46*d* are essentially parallelly inclined in the front-to-back direction, therefore the distance between the ascending portion front wall 46*c* and the ascending portion rear wall 46*d* is essentially constant from the inlet to the outlet on the ascending portion 46*b*.

As shown in FIG. 4, the cross section B of the ascending conduit 46 ascending portion 46*b* has essentially an "arch shape on the urinal outer side (rear side) relative to the center line C2 in the front-to-back direction of cross section B; and an essentially trapezoidal shape on the inner side (front side) of the urinal.

In the cross section B of the ascending portion 46*b* of the ascending conduit 46, the surface area S3 on the urinal inner side is smaller than the surface area S4 of the outer side of the urinal.

Note that the width measurement in the front-to-back direction of the cross section of the ascending conduit 46 is essentially the same as the minimum width direction of the flow path cross section of the outlet 42*d* of the descending conduit 42.

In addition, the cross sectional shape of the ascending conduit 46 second bending portion 46*a* is the same as the cross section A of the horizontal portion 44*c* over the entire span of the flow direction, but it may also change continuously toward the downstream side from the cross sectional shape of the horizontal conduit 44 horizontal portion 44*c* to the shape of cross section B of the ascending conduit 46 ascending portion 46*b*.

The cross section B of the ascending conduit 46 ascending portion 46*b* is essentially the same shape from the inlet to the outlet of the ascending conduit 46 ascending portion 46*b*, therefore the cross sectional area of the cross section B of the ascending conduit 46 ascending portion 46*b* is essentially constant from the inlet to the outlet of the ascending conduit 46 ascending portion 46*b*.

As described above, the common wall 48 is formed by the descending conduit front wall 42*a*, which is the side surface on the rear side of the descending conduit 42, and the ascending portion front wall 46*c*, which is the side surface on the front side of the ascending conduit 46.

Flush water inside the discharge trap portion 40 thus flows downward in the descending conduit 42, changes direction in the vicinity of the common wall 48, turning nearly half a revolution about the return flow path forming portion 48*a* at the bottom of the common wall 48 as it passes through the horizontal conduit 44, and flows upward inside the ascending conduit 46.

I.e., the discharge trap portion 40 of the present embodiment is formed to create a flow which changes direction from a downward flow through the descending conduit 42, suddenly turning back as it passes through the horizontal conduit 44, then changes flow direction to an approximately 180° upward direction inside the ascending conduit 46 formed on the reverse side (rear side) which sandwiches the common wall 48.

Next, the operation of a urinal based on the above-described embodiment of the present invention will be explained.

Before a user urinates, low urine concentration flush water exists as pooled water in the discharge trap portion 40.

When a user urinates in the urinal 1, urine flows from the bowl portion 10 discharge port 14 into the discharge trap portion 40, and the majority of the originally existing low urine concentration pooled water is discharged (substituted) by the flowed-in urine, so that pooled water with an extremely high urine concentration containing a mixture of urine and water is present in the discharge trap portion 40.

When a user finishes urinating and leaves the front of urinal 1, a predetermined amount of flush water W is spouted into bowl portion 10 by spouting device 20 in response to the output of a body sensor (not shown), spreading out and flowing down the bowl portion 10, reaching the discharge port 14.

At the point, the flush water W flows down as an essentially uniform flow volume from the direction of the entire circumference toward the discharge port 14.

Here, because the descending conduit front wall 42*a* and the descending conduit rear wall 42*b* of the descending conduit 42 are symmetrical relative to the center axis line C of the descending conduit 42, the flow of flush water flowing down the descending conduit 42 is symmetrical relative to the center axis line C.

Therefore the flush water flow becomes a downward flow, essentially uniform in the front-to-back and left-to-right directions, and flush water can flow smoothly without flow stagnation in the descending conduit 42, so that flush water flowing into the horizontal conduit 44 horizontal conduit inlet 44*a* also forms an approximately uniform downward inflow in the front-to-back and left-to-right directions.

Also, because the cross sectional area of the descending conduit 42 on the above-described discharge trap portion 40 gradually declines from the descending conduit 42 to the outlet 42*d*, the flow speed inside the descending conduit 42 increases toward the downstream side, and flow stagnation in the horizontal conduit 44 is constrained.

Moreover, the cross sectional shape of the discharge trap portion 40 descending conduit 42 is essentially circular, therefore the cross sectional area of the descending conduit 42 is larger than the surface area of the inlet portion of the horizontal conduit 44, and the flow into the horizontal conduit 44 is accelerated, thus constraining the stagnation of flow in the horizontal conduit 44.

Next the flow within the horizontal conduit 44 of the discharge trap portion 40 will be explained.

In the front-to-back and left-to-right directions, flush water flowing into the horizontal conduit 44 horizontal conduit inlet 44*a* forms an essentially uniform in-flow in the downward direction, and the cross sectional shape in the draining direction of the first bent portion 44*b* from the horizontal conduit inlet 44*a* to the horizontal portion 44*c* may, as described above, be such that the surface area on the inside of the cross section center line is smaller than the surface area on the outside of the cross section center line.

Therefore the speed difference arising when the cross sectional shape of the first bent portion 44*b* of the horizontal conduit 44 is essentially circular, between the flow speed inside the cross section center line and the flow speed outside the cross section center line, is constrained.

Thus in the first bent portion 44*b* the flow speed on the inside of center line C1 on cross section A and the flow speed on the outside of center line C1 on cross section A is essentially uniform, and stagnation of flow in the first bent portion 44*b* is constrained.

With respect to the horizontal portion 44*c* connected to the first bent portion 44*b*, as well, because the has the same cross sectional shape as the first bent portion 44*b*, the flow speed on the inside of the cross section A center line C1 and the flow speed on the outside of the cross section A center line C1 are essentially uniform, and stagnation of flows in the horizontal portion 44*c* is constrained.

Next the flow within the ascending conduit 46 of the discharge trap portion 40 will be explained.

The cross sectional shape in the water draining direction of the second bending portion 46*a*, which communicates from the horizontal conduit 44 outlet 44*d* up to the outlet of the ascending portion 46*b* on the ascending conduit 46, as described above, is such that the surface area on the inside of the cross section center line is smaller than the surface area on the outside of the cross section center line.

For the reason, the speed difference occurring when the cross sectional shape of the ascending conduit 46 second bending portion 46*a* is essentially circular between the flow speed on the inside of the cross section center line and the flow speed on the outside of the cross section center line is constrained, therefore the flow speed on the inside of the cross section center line and the flow speed on the outside of the cross section center line are essentially uniform, and stagnation of flow in the second bending portion 46*a* is constrained.

Moreover, the ascending conduit 46 ascending portion 46*b* has the same cross sectional shape as the second bending portion 46*a*, therefore the flow speed on the inside of the cross section B center line C2 and the flow speed on the outside of the cross section B center line C2 are essentially uniform, and stagnation of flow inside the ascending portion 46*b* is constrained.

Because the cross sectional area of the ascending conduit 46 ascending portion 46*b* is essentially constant from the inlet to the outlet thereof, flush water flowing into the ascending conduit 46 ascending portion 46*b* is able to essentially maintain its flow speed distribution as it flows from the inlet to the outlet in the ascending conduit 46 ascending portion 46*b*.

As described above, the ascending conduit 46 ascending portion 46*b* forms a wall surface in the front-to-back direction parallel to the ascending portion front wall 46*c* and the ascending portion rear wall 46*d*, and is formed to have the same slope and slope angle, therefore in the front-to-back direction a relatively parallel ascending flow is formed by the flow F3 along the common wall 48 and the flow F4 along the ascending conduit rear wall 40*b*.

In addition, the distance between the ascending portion front wall 46*c* and the ascending portion rear wall 46*d* is formed to be constant from the inlet portion to the outlet portion of the ascending conduit 46 ascending portion 46*b*, thereby inhibiting turbulence in the flow along each wall surface, such that flow can occur without interference between flows or the creation of stagnation.

Using the urinal 1 of the above-described embodiment, the above-described structure was adopted for the discharge trap portion 40, therefore pooled water with an extremely high urine concentration consisting of urine and water in the discharge trap portion 40 is discharged so as to be efficiently substituted (replaced) by new flush water flowing into the discharge trap portion 40.

Therefore even when the flush water amount is reduced, high urine concentration pooled water in the discharge trap portion 40 can be efficiently substituted by a relatively small amount of flush water, and the pooled water substitution rate improved.

Flush water flowing out of the discharge trap portion 40 ascending conduit 46 flows into the discharge chamber 60 and is discharged from the discharge chamber 60 through the discharge socket 52 to the discharge piping 54.

The spout device 30 spouts water toward the bowl portion 10 for a fixed time then stops spouting, thus completing one iteration of the urinal 1 flushing operation.

Immediately after the completion of the iteration of the urinal 1 flushing operation, low urine concentration flush water is present as pooled water inside the discharge trap portion 40, and because the pooled water substitution rate has been improved in the manner, the concentration of urine remaining in the pooled water in the discharge trap portion 40 after completion of each iteration of the urinal 1 flushing operation is reduced to a certain base level or below, and the adhesion (occurrence) of uric scale in the discharge trap portion 40 due to residual urine component in pooled water is constrained.

Using the urinal 1 according to the above-described embodiment of the invention, the cross section perpendicular to the water discharge direction of at least one of either the horizontal conduit 44 or the ascending conduit 46 on the discharge trap portion 40 is formed so that the side of the urinal to the inside of the center of the cross section has a smaller cross sectional area than the side of the urinal to the outside of the center of the cross section, therefore flow speed differentials are constrained between the flow speed on the inside of the center of the cross section and the flow speed on the outside of the center of the cross section of the discharge trap portion 40 horizontal conduit 44 or ascending conduit 46, with the result that stagnation of flow in the horizontal conduit 44 or the ascending conduit 46 is constrained, so that the pooled water substitution rate inside the discharge trap portion 40 is improved, and deposition of uric scale in the horizontal conduit 44 or the ascending conduit 46 can be improved.

Also, using the urinal 1 according to the present embodiment, the discharge trap portion 40 ascending conduit 46 is formed so that its cross sectional area is essentially constant from the inlet to the outlet thereof, thereby inhibiting the occurrence of changes in flow speed within the discharge trap portion 40 ascending conduit 46 so that stagnation of flow in the discharge trap portion 40 ascending conduit 46 can be constrained, as can the deposition of uric scale in the ascending conduit 46.

In addition, using the urinal 1 according to the present embodiment, the discharge trap portion 40 descending conduit 42 is formed so that its cross sectional area gradually decreases from the inlet to the outlet, therefore flow speed inside the descending conduit 42 increases toward the downstream side such that substitution of pooled water in the discharge trap portion 40 is quickly carried out, thereby constraining the deposition of uric scale in the horizontal conduit 44 and the ascending conduit 46.

Also, using the urinal 1 according to the present embodiment, the cross section of the discharge trap portion 40 descending conduit 42 is formed to be essentially circular, therefore the descending conduit 42 cross sectional area is larger than the surface area of the horizontal conduit 44 horizontal conduit inlet 44*a*, and the flow flowing into the horizontal conduit 44 is accelerated more than in the descending conduit 42, so that stagnation of flow in the descending conduit 42 is constrained, and deposition of uric scale in the descending conduit 42 is further constrained.

Moreover, in the urinal 1 according to the present embodiment, the discharge trap portion 40 horizontal conduit 44 and ascending conduit 46 are formed so that their respective cross section width dimensions are essentially the same size as the smallest flow path cross section width dimension in the descending conduit 42 outlet 42*d*, therefore the discharge water flow speed inside the discharge trap portion 40 is maintained, and the increased difficult in forming turbulent currents means that flow stagnation in the horizontal conduit 44 or the ascending conduit 46 is constrained, therefore substitution of pooled water in the discharge trap portion 40 is quickly accomplished, and deposition of uric scale in the horizontal conduit 44 or the ascending conduit 46 can be further constrained.

What is claimed is:

1. A urinal for receiving and discharging urine, comprising:

a bowl portion having a bowl surface for receiving urine;

a spouting device disposed on a top portion of the bowl portion for spouting flush water onto the bowl surface; and a discharge trap portion, communicating with a discharge port disposed on a bottom portion of the bowl portion, for discharging flush water and forming a water seal on a downstream side of the bowl portion;

wherein the discharge trap portion includes a descending conduit extending downward from the discharge port, a horizontal conduit connected to the descending conduit and extending horizontally, and an ascending conduit connected to an outlet of the horizontal conduit and extending upward; and wherein a cross section perpendicular to a discharging direction of the horizontal conduit is formed so that an inner side of the urinal from a center of the cross section of the horizontal conduit has a smaller cross sectional area than an outer side of the urinal from the center of the cross section of the horizontal conduit and/or a cross section perpendicular to a discharging direction of the ascending conduit is formed so that an inner side of the urinal from a center of the cross section of the ascending conduit has a smaller cross sectional area than an outer side of the urinal from the center of the cross section of the ascending conduit.

2. A urinal according to claim 1, wherein the ascending conduit of the discharge trap portion is formed so that a cross sectional area thereof is essentially constant from an inlet thereof to an outlet thereof.

3. A urinal according to claim 1, wherein the descending conduit of the discharge trap portion is formed so that a cross sectional area thereof gradually decreases from an inlet thereof to an outlet thereof.

4. A urinal according to claim 2, wherein the descending conduit of the discharge trap portion is formed so that a cross sectional area thereof gradually decreases from an inlet thereof to an outlet thereof.

5. A urinal according to claim 1, wherein the descending conduit of the discharge trap portion is formed so that a cross section thereof is essentially circular.

6. A urinal according to claim 2, wherein the descending conduit of the discharge trap portion is formed so that a cross section thereof is essentially circular.

7. A urinal according to claim 3, wherein the descending conduit of the discharge trap portion is formed so that a cross section thereof is essentially circular.

8. A urinal according to claim 1, wherein the horizontal conduit and the ascending conduit of the discharge trap portion are respectively formed so that a width dimension of cross sections thereof has essentially the same size as the smallest width dimension of a flow path cross section at an outlet of the descending conduit.

9. A urinal according to claim 2, wherein the horizontal conduit and the ascending conduit of the discharge trap portion are respectively formed so that a width dimension of cross sections thereof has essentially the same size as the smallest width dimension of a flow path cross section at an outlet of the descending conduit.

10. A urinal according to claim 3, wherein the horizontal conduit and the ascending conduit of the discharge trap portion are respectively formed so that a width dimension of cross sections thereof has essentially the same size as the smallest width dimension of a flow path cross section at an outlet of the descending conduit.

11. A urinal according to claim 4, wherein the horizontal conduit and the ascending conduit of the discharge trap portion are respectively formed so that a width dimension of cross sections thereof has essentially the same size as the smallest width dimension of a flow path cross section at an outlet of the descending conduit.

12. A urinal according to claim 1, wherein the inner side of the urinal from a center of the cross section of the horizontal conduit has an essentially trapezoidal cross sectional shape and the outer side of the urinal from a center of the cross section of the horizontal conduit has an essentially semicircular cross sectional shape.

13. A urinal according to claim 1, wherein the inner side of the urinal from a center of the cross section of the ascending conduit has an essentially trapezoidal cross sectional shape and the outer side of the urinal from a center of the cross section of the ascending conduit has an essentially arched cross sectional shape.

* * * * *